US006895953B2

(12) United States Patent
Larsen et al.

(10) Patent No.: US 6,895,953 B2
(45) Date of Patent: May 24, 2005

(54) GAS COOKING APPLIANCE WITH LOUVERED BURNER BAFFLE

(75) Inventors: Christopher A. Larsen, Dorchester, MA (US); Gerald R. Place, East Ridge, TN (US); Steven M. Swayne, Chattanooga, TN (US); Dutch VanZandt, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/385,651

(22) Filed: Mar. 12, 2003

(65) Prior Publication Data

US 2004/0177842 A1 Sep. 16, 2004

(51) Int. Cl.[7] ..... F24C 3/08
(52) U.S. Cl. ..... 126/41 R; 431/264
(58) Field of Search ..... 126/41 R, 39 B, 126/39 BA; 431/264

(56) References Cited

U.S. PATENT DOCUMENTS 3,682,156 A * 8/1972 Perl ..... 126/21 A
3,832,990 A * 9/1974 Trosch ..... 126/41 R
4,598,691 A 7/1986 Herrelko et al.
4,718,400 A * 1/1988 Lotz et al. ..... 126/41 R
4,905,660 A 3/1990 Leduc
5,038,748 A * 8/1991 Lockwood et al. ..... 126/19 R
5,534,678 A 7/1996 Bowles et al.

FOREIGN PATENT DOCUMENTS

JP 58130907 A * 8/1983

* cited by examiner

*Primary Examiner*—Alfred Basichas
(74) *Attorney, Agent, or Firm*—Diederiks & Whitelaw, PLC

(57) ABSTRACT

A gas cooking appliance includes at least one oven cavity which is coated with a heat resistant material, preferably porcelain. The cooking appliance includes a gas broil element and an associated baffle, as well as a gas igniter, arranged atop the oven cavity. The baffle is provided with one or more openings above the igniter for ventilation purposes. Each opening is preferably defined by a louver. With the inclusion of the louvered opening, enhanced combustion is assured and any potential crazing zone of the oven cavity is shifted to a position wherein, should any heat resistant material chip off due to heat from the igniter, the material will be blocked from falling into any food support zone of the oven cavity.

11 Claims, 3 Drawing Sheets

GAS COOKING APPLIANCE WITH LOUVERED BURNER BAFFLE

BACKGROUND OF THE INVENTION

1. Field of the Invention

The present invention pertains to the art of gas cooking appliances and, more particularly, to incorporating a louvered burner baffle in a gas oven employing an electrical igniter.

2. Discussion of the Prior Art

In a gas cooking appliance, one or more burners are arranged in an oven cavity to develop the necessary heat for desired cooking operations. Typically, one burner element is arranged at the bottom of the oven cavity, perhaps under a false bottom, and another burner element is arranged atop the oven cavity, particularly for broiling purposes. Generally, a baffle plate is utilized to disperse the heat generated in connection with operation of the burner element. Often times, the oven cavity is coated with a heat resistant material, such as porcelain.

In order to initiate combustion of gases delivered to one or more of the burner elements, an igniter is typically mounted adjacent the burner element. In mounting the igniter, care must be taken to prevent the igniter from blocking a combustion airflow to the burner element. In addition, it is possible for the porcelain, if exposed to direct heat from the igniter, to craze and chip. The porcelain that chips can actually fall down into the oven cavity, perhaps even into food being cooked therein.

Obviously, the need for adequate combustion air must be addressed, along with the potential for any falling of porcelain chips. With respect to the latter, once such approach concerns employing an aluminized top panel within a porcelain coated oven cavity to protect the coating. Regardless of this known prior art, there still exists a need in the art for an arrangement which enhances the combustion of gas for a burner element having an associated baffle in a coated oven cavity, minimizes the potential for crazing of the coating material, and prevents any coating material from falling into food placed in the oven cavity.

SUMMARY OF THE INVENTION

The present invention is directed to a gas cooking appliance including at least one oven cavity which is coated with a heat resistant material, preferably porcelain. The cooking appliance includes a gas broil element and an associated baffle, as well as a gas igniter, arranged atop the oven cavity. The baffle is provided with one or more openings above the igniter for ventilation purposes. In accordance with the most preferred form of the invention, the baffle includes a louver which defines an opening extending through the baffle. With the inclusion of the louvered opening, enhanced combustion is assured. In addition, any potential crazing zone of the oven cavity is shifted to a position wherein, should any heat resistant material chip off due to heat from the igniter, the material will be blocked from falling into any food support zone of the oven cavity.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
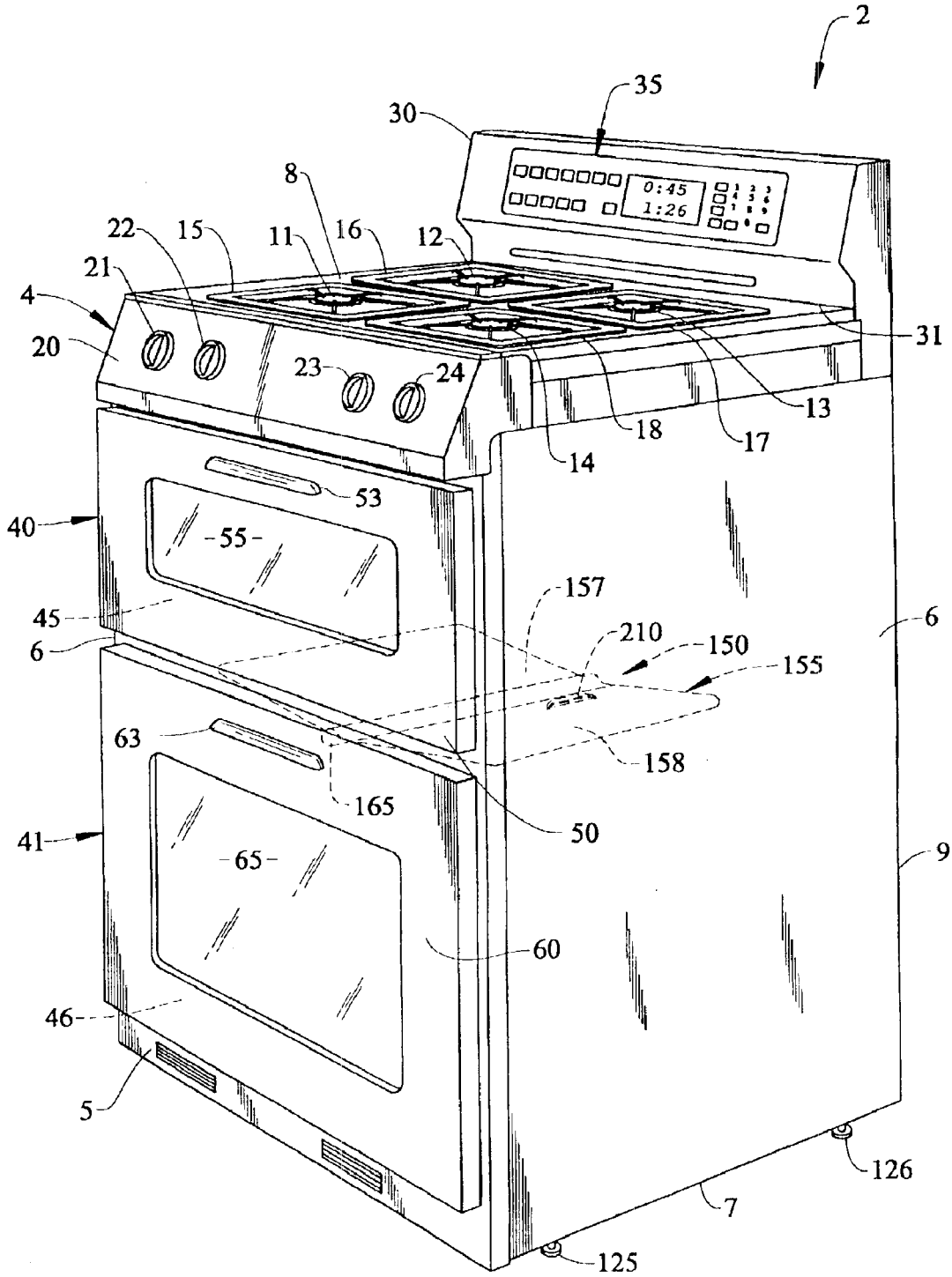
FIG. 1 is an upper right front perspective view of a cooking appliance incorporating a louvered burner baffle and igniter arrangement configured in accordance with a preferred embodiment of the present invention.

With initial reference to FIG. 1, the exhaust cooling system of the present invention is preferably incorporated into a cooking appliance generally indicated at 2. As shown, cooking appliance 2 takes the form of a free-standing gas range unit. Range 2 includes a cabinet 4 having a front panel portion 5, opposing side panel portions 6, a bottom portion 7, a range top 8, and a main back panel 9. Within the scope of the invention, range top 8 can take on various forms. In the preferred embodiment shown, range top 8 is provided with various gas burner elements 11–14 and associated burner grates 15–18. Cabinet 4 further includes a front control surface 20. Preferably, control surface 20 supports a plurality of control knobs 21–24 for controlling the activation/de-activation of gas burners 11–14 respectively. Furthermore, cabinet 4 includes an upstanding control panel 30 arranged at an upper rear portion 31 of cabinet 4. In the embodiment shown, control panel 30 includes a central control and display unit, generally indicated at 35, for use in controlling a first or upper oven 40 and a second or lower oven 41.

In the preferred embodiment, upper oven 40 includes a respective first or upper oven cavity 45 and, similarly, lower oven 41 includes a respective second or lower oven cavity 46. In accordance with the present invention, oven cavities 45 and 46 are preferably formed of metal and coated with a heat resistant material, such as porcelain. In a manner known in the art, upper oven 40 has associated therewith a door 50 which can be pivoted by means of a handle 53. Door 50 preferably includes a window 55 for viewing the contents of upper oven cavity 45. In a similar manner, lower oven 41 has associated therewith a door 60, a handle 63 and a window 65.

Figure 2:
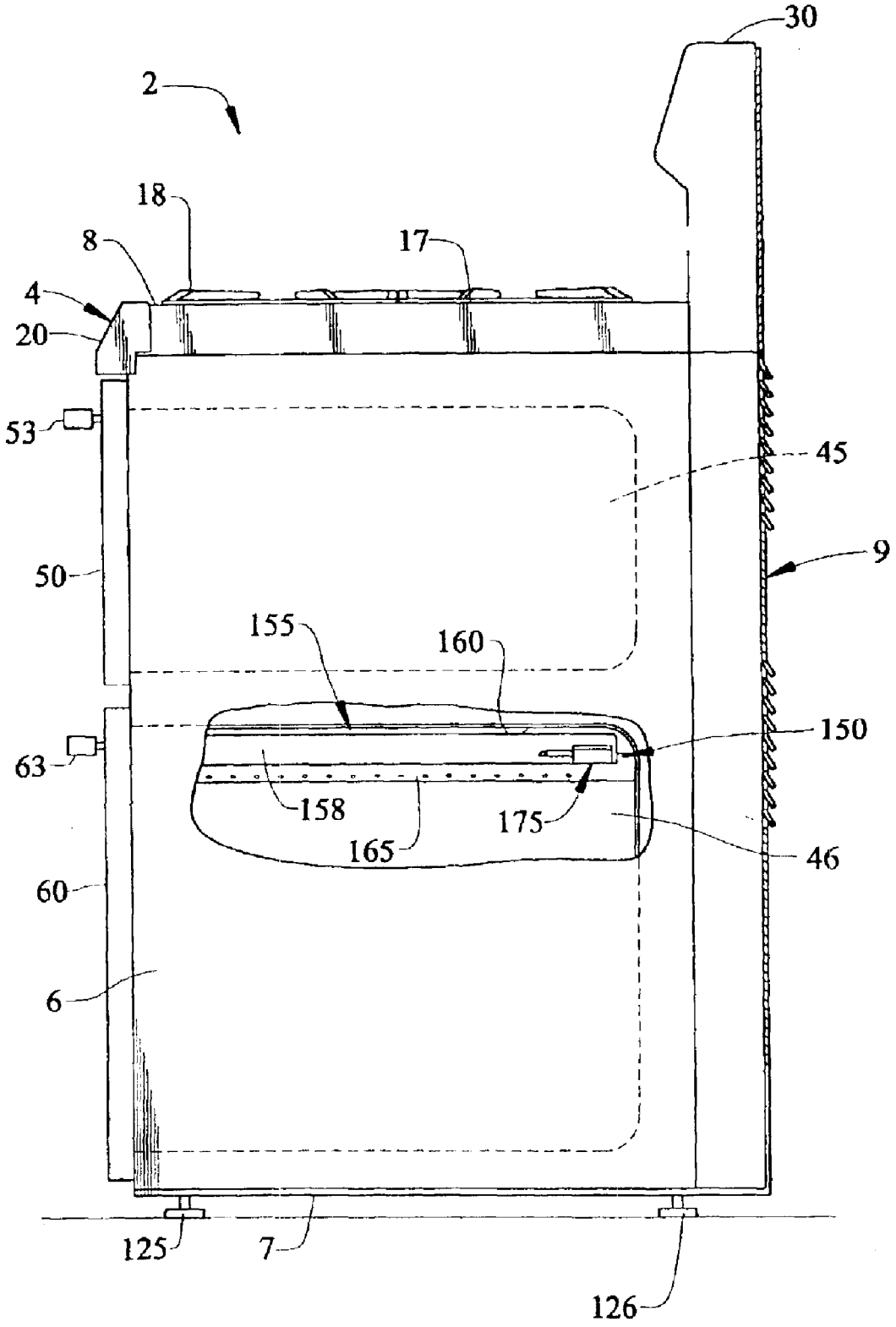
FIG. 2 is a partial, cross-sectional side view of the cooking appliance of FIG. 1 showing the louvered baffle and igniter arrangement.
Figure 3:
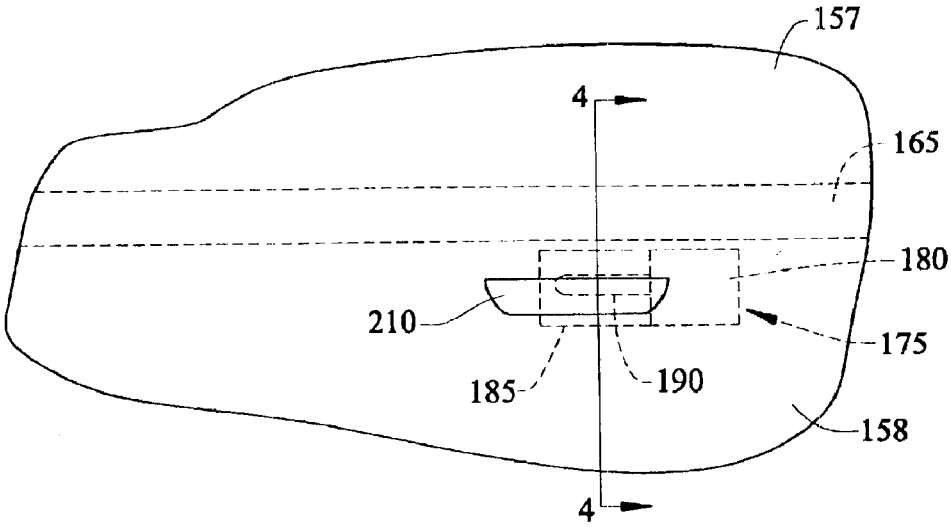
FIG. 3 is an enlarged top view of the louvered baffle and igniter arrangement of FIG. 2.
Figure 4:
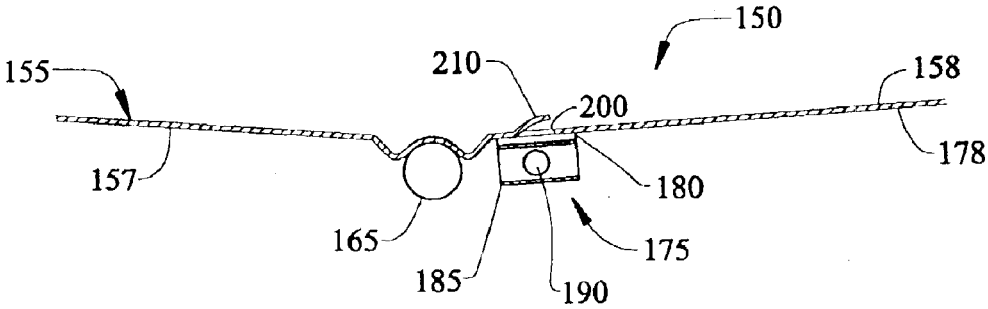
FIG. 4 is a front plan view of the louvered burner baffle and igniter arrangement of the invention.

In a manner known in the art, range 2 is adapted to be mounted upon a supporting surface, such as a kitchen floor or the like. More specifically, a plurality of leg members, two of which are indicated in FIGS. 1 and 2 at 125 and 126, extend from bottom portion 7 at front and rear portions of cabinet 4, along side panel 6. Of course, corresponding leg members 125 and 126 are also provided on the opposing side of range 2. In any event, the various leg members 125 and 126 are preferably vertically adjustable to also act as levelers for range 2. Such type of leg leveler arrangements are widely known in the art of appliances, including both ranges and refrigerators such that the leveling function of leg members 125 and 126 does not form part of the present invention. Instead, the invention is actually directed to the construction and arrangement of a louvered burner baffle and igniter arrangement which is generally indicated in FIG. 1 at 150 in connection with oven cavity 46 as will be more fully discussed below.

As indicated in FIGS. 1 and 2, burner baffle and igniter arrangement 150 includes a heat dispersing burner baffle 155 which generally takes the form of a flattened, V-shaped metal plate so as to define side panels 157 and 158. Baffle 155 extends adjacent an upper wall 160 of oven cavity 46 and has arranged thereunder a central, fore-to-aft extending gas burner element 165. As the construction and operation of gas burner element 165, which obviously defines a broiler element for oven cavity 46, is known in the art and does not form part of the present invention, it will not be discussed in detail here. However, it should be recognized that burner element 165 is adapted to receive a flow of gas, either natural gas or propane, which is mixed with a supply of air from within oven cavity 46 for combustion purposes.

In order to ignite the combustion mixture, an igniter 175 is employed. As shown, igniter 175 is mounted to an underside 178 of panel 158, adjacent burner element 165. Igniter 175 preferably constitutes a hot element-type gas igniter known in the art. More specifically, igniter 175 includes an housing 180, a shield 185 and an ignition element 190. Certainly, the positioning of igniter 175 will affect the flow of air for combustion purposes, particularly if igniter 175 is mounted horizontally. In accordance with the present invention, at least one opening 200 is formed above igniter 175 in panel 158 of baffle 155. With this arrangement, opening 200 will provide for additional airflow for combustion purposes.

The general inclusion of opening 200 presents a potential problem concerning the crazing, and possible subsequent chipping, of the porcelain or other heat resistant coating provided in oven cavity 46. To address this concern, the present invention advantageously provides a cover, which is preferably constituted by a louver 210 formed in panel 158 of baffle 155, over opening 200. With this arrangement, an potential crazing area is shifted away from the combustion air flowing through opening 200. More specifically, not only is the potential area for crazing significantly reduced, but louver 210 is positioned in such a manner so as to block a vertical path through opening 200 in the event that any chips should develop. Therefore, louver 210 advantageously allows ample ventilation, moves the potential crazing zone essentially to a position over burner element 165 and away from a path where chips could drop into food, and blocks the path of any porcelain particles directly over igniter 175.

Although described with reference to a preferred embodiment of the invention, it should be readily understood that various changes and/or modifications can be made to the invention without departing from the spirit thereof. For instance, although an integral louver is employed in the most preferred embodiment of the invention, other cover structures could also be employed, such as a separate member attached to the baffle. In addition, although a single fore-to-aft extending louver is preferably employed, multiple louver, laterally extending or otherwise, could also be utilized. In general, the invention is only intended to be limited by the scope of the following claims.

We claim:

1. A cooking appliance comprising:

an oven cavity including a top wall coated with a heat resistant material;

a burner element positioned adjacent the top wall of the oven cavity, said burner element being adapted to receive a flow of combustible gas;

an igniter arranged adjacent the burner element for igniting the flow of combustible gas; and a baffle for dispersing heat generated during operation of the burner element, said baffle being positioned adjacent the top wall of the oven cavity, said baffle being formed with a louver defining an opening in the baffle.

2. The cooking appliance according to claim 1, wherein the louver is arranged above the igniter.

3. The cooking appliance according to claim 2, wherein the louver blocks a vertical path from a crazing area of the top wall of the oven cavity.

4. The cooking appliance according to claim 2, wherein the louver extends fore-to-aft in the oven cavity.

5. The cooking appliance according to claim 1, wherein the cooking appliance constitutes a range further comprising:

a cabinet including at least an upper rear portion, a back panel, opposing side panels and a top surface, said cabinet being adapted to rest upon a supporting surface;

a plurality of heating elements arranged about the top surface; and another oven cavity arranged within the cabinet.

6. A cooking appliance comprising:

an oven cavity including a top wall coated with a heat resistant material;

a burner element positioned adjacent the top wall of the oven cavity, said burner element being adapted to receive a flow of combustible gas;

an igniter arranged adjacent the burner element for igniting the flow of combustible gas;

a baffle for dispersing heat generated during operation of the burner element, said baffle being positioned adjacent the top wall of the oven cavity, said baffle being formed with an opening arranged above the igniter; and a cover member extending across at least a portion of the opening.

7. The cooking appliance according to claim 6, wherein the cover member extends from the baffle member over the opening.

8. The cooking appliance according to claim 7, wherein the cover member constitutes a louver.

9. The cooking appliance according to claim 6, wherein the cover member blocks a vertical path from a crazing area of the top wall of the oven cavity.

10. The cooking appliance according to claim 6, wherein the cover member extends fore-to-aft in the oven cavity.

11. The cooking appliance according to claim 6, wherein the cooking appliance constitutes a range further comprising:

a cabinet including at least an upper rear portion, a back panel, opposing side panels and a top surface, said cabinet being adapted to rest upon a supporting surface;

a plurality of heating elements arranged about the top surface; and another oven cavity arranged within the cabinet.

* * * * *